US008272811B2

(12) United States Patent
Wang et al.

(10) Patent No.: US 8,272,811 B2
(45) Date of Patent: Sep. 25, 2012

(54) PROCESS FOR GROUTING A CURTAIN WITH POLYMER

(75) Inventors: Fuming Wang, Zhengzhou (CN); Jianwu Wang, Zhengzhou (CN); Mingsheng Shi, Zhengzhou (CN); Wenting Liu, Zhengzhou (CN); Chengchao Guo, Zhengzhou (CN); Qiang Li, Zhengzhou (CN); Xiaoliang Wang, Zhengzhou (CN)

(73) Assignee: Zhengzhou U-Trust Infrastructure Rehabilitation Ltd., Zhengzhou, Henan Province (CN)

( * ) Notice: Subject to any disclaimer, the term of this patent is extended or adjusted under 35 U.S.C. 154(b) by 236 days.

(21) Appl. No.: 12/721,424

(22) Filed: Mar. 10, 2010

(65) Prior Publication Data

US 2011/0103899 A1 May 5, 2011

(30) Foreign Application Priority Data

Nov. 2, 2009 (CN) ..... 2009 1 0066335
Dec. 29, 2009 (CN) ..... 2009 1 0227698

(51) Int. Cl.
*E02D 5/20* (2006.01)

(52) U.S. Cl. ..... 405/267; 405/107; 405/116; 405/270

(58) Field of Classification Search ..... 405/107, 405/116, 117, 263, 264, 266, 267, 268, 269, 405/270

See application file for complete search history.

(56) References Cited

U.S. PATENT DOCUMENTS

| | | | | | |
|---|---|---|---|---|---|
| 3,326,003 | A * | 6/1967 | Marconi | 405/267 |
| 3,969,902 | A * | 7/1976 | Ichise et al. | 405/267 |
| 4,212,565 | A * | 7/1980 | Watabe | 405/269 |
| 4,741,644 | A * | 5/1988 | Cavalli et al. | 405/267 |
| 4,909,674 | A * | 3/1990 | Konno et al. | 405/267 |
| 5,022,792 | A * | 6/1991 | Konno et al. | 405/267 |
| 5,403,125 | A * | 4/1995 | Andersen | 405/267 |
| 5,487,622 | A * | 1/1996 | Cherry et al. | 405/267 |
| 5,547,504 | A * | 8/1996 | Soroushian | 405/267 |
| 5,551,807 | A * | 9/1996 | Breaux | 405/267 |
| 5,758,991 | A * | 6/1998 | Shiosaka | 405/267 |
| 5,816,748 | A * | 10/1998 | Kleiser et al. | 405/268 |
| 6,241,426 | B1 * | 6/2001 | Schellhorn | 405/267 |
| 6,554,544 | B1 * | 4/2003 | Barkasz | 405/267 |
| 2008/0260473 | A1 * | 10/2008 | Smith et al. | 405/267 |
| 2009/0304457 | A1 * | 12/2009 | Shimada et al. | 405/266 |

FOREIGN PATENT DOCUMENTS

| | | | |
|---|---|---|---|
| JP | 62029611 | A * | 2/1987 |
| JP | 02266024 | A * | 10/1990 |

* cited by examiner

*Primary Examiner* — Frederick L Lagman

(57) ABSTRACT

A process for grouting a super-thin curtain with polymer, includes: forming a series of V-shaped injecting holes by direct pushing method using a special drilling tool along a dam or dike axis spacedly at a predetermined distance; and injecting a two-component polymer composition into each of the holes, wherein the mixed polymer material expends and coagulates under chemical reaction to form a series of super-thin curtain segments, and the curtain segments connect with each other end to end to form a continuous and impermeable polymer curtain.

18 Claims, 2 Drawing Sheets

PROCESS FOR GROUTING A CURTAIN WITH POLYMER

BACKGROUND OF THE PRESENT INVENTION

1. Field of Invention

The present invention relates generally to methods for the construction of seepage barriers, and more particularly to a method that utilizes polymer grout to construct anti-seepage curtains with improved impermeability for dams and dikes.

2. Background

The safety of hydraulic infrastructures such as reservoirs is one of the top priority safety concerns. If a reservoir collapses, it could cause a heavy lost of properties or even casualties. Seepage, a problem commonly associated with dams or dikes, is generally considered as a hidden danger. Many dam disasters were caused by the failure of their anti-seepage systems. Various solutions have been proposed ranging from high pressure jet grouting, curtain grouting to impermeable concrete walls. The prior art, however, has significant shortcomings: time consuming, labor intensive, low efficiency, repair-induced structure disturbance or even damage to the dam itself.

High pressure jet grouting applies large energy to the grout with high pressure devices, but the energy is hard to control. Excessive jetting energy could cause punching-shear failure to the soil. It may also cause overall unevenness in strength during the process when the grout is forming. In addition to that, holes may be formed in the soil because the grout takes too long to coagulate.

Curtain grouting presents different kind of problems. Curtain grouting is generally processed by section due to the fact that construction sites are usually massive. Grouting by section gives rise to problems such as uneven thickness in curtain, loose joints between sections, soil debris getting into the joints, insufficient depth, or unwanted sediments formed at the bottom of the curtain walls.

As for the method of constructing impermeable concrete walls, some of its problems include miscalculation in wall structure strength, rush design relying on empirical experience, and construction high cost. Concerns of this nature have limited the wide adoption of impermeable concrete walls. Traditionally, research on impermeable materials has focused on plastic concrete and high strength concrete (reinforced concrete). The high strength concrete may cause high stress due to high elastic modulus whereas the plastic concrete is notorious for its low strength, low impermeability and weak durability. Besides, concrete walls are not water-tight and always come with some degree of water seeping. The prior art has yet to deal with this problem effectively. Needless to say, better impermeable materials or construction methods are needed.

Grouting with polymer, a method developed since 1970s, allows rapid treatment for foundation repair. It has been used to reinforce foundations, fill up hollow spaces underground, or elevate floor by injecting two-component polymer materials into the foundation which then expands under chemical reaction and then coagulates. At present, grout polymer has been applied mostly in foundation repair or road maintenance. No reports have been found on utilizing polymer grout for the construction of anti-seepage curtains for dams and dikes.

SUMMARY OF THE PRESENT INVENTION

The present invention overcomes the shortcomings of the prior art by providing a novel method for constructing polymer grout curtains for dams and dikes. The objective is to provide a novel anti-seeping measure and means which is more sophisticated, more efficient, more cost-effective, and easier to implement.

The said invention comprises the following apparatus and methods:

A series of V-shaped holes are bored in dam which lays the formation for the polymer curtains. The holes are made with a V-shaped drilling bit apparatus specially designed for the process. The holes are lined up in a way that the edges of the Vs are overlapped, forming a continous W-like structure. When being injected into the holes, the polymer composition will expand instantly as a consequence of chemical reactions. Before coagulating, the polymer fills up the holes and forces through the directional cut channels between the holes and connects the polymer grout in its neighboring holes one another end to end, forming a continuous polymer curtain.

The execution of the said method comprises these steps:

- Along the axis of a dam, at a pre-determined spacing distance, making a series of V-shaped injecting holes by a direct pushing method using a special drill bit with two wide wings. The wings of the holes are overlapped, forming a continuous W-like structure.
- Injecting the non-water reacted two-component polymer composition into each of the holes, wherein the polymer composition expands and coagulates inside each of the holes to form a series of super-thin curtain segments. The curtain segments connect with each other end to end to form a continuous polymer curtain.

DETAILED DESCRIPTION OF THE PREFERRED EMBODIMENT

Figure 1:
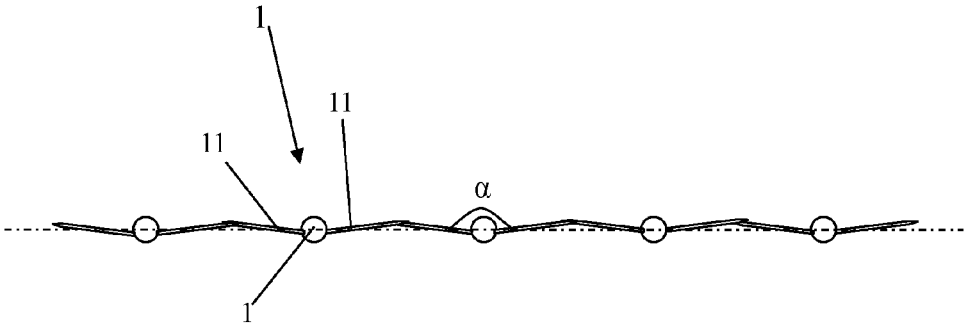
FIG. 1 is a plan sketch view of the V-shaped injecting holes made by a direct pushing method using a special drilling bit with two wide wings according to the preferred embodiment of the present invention.
Figure 2:
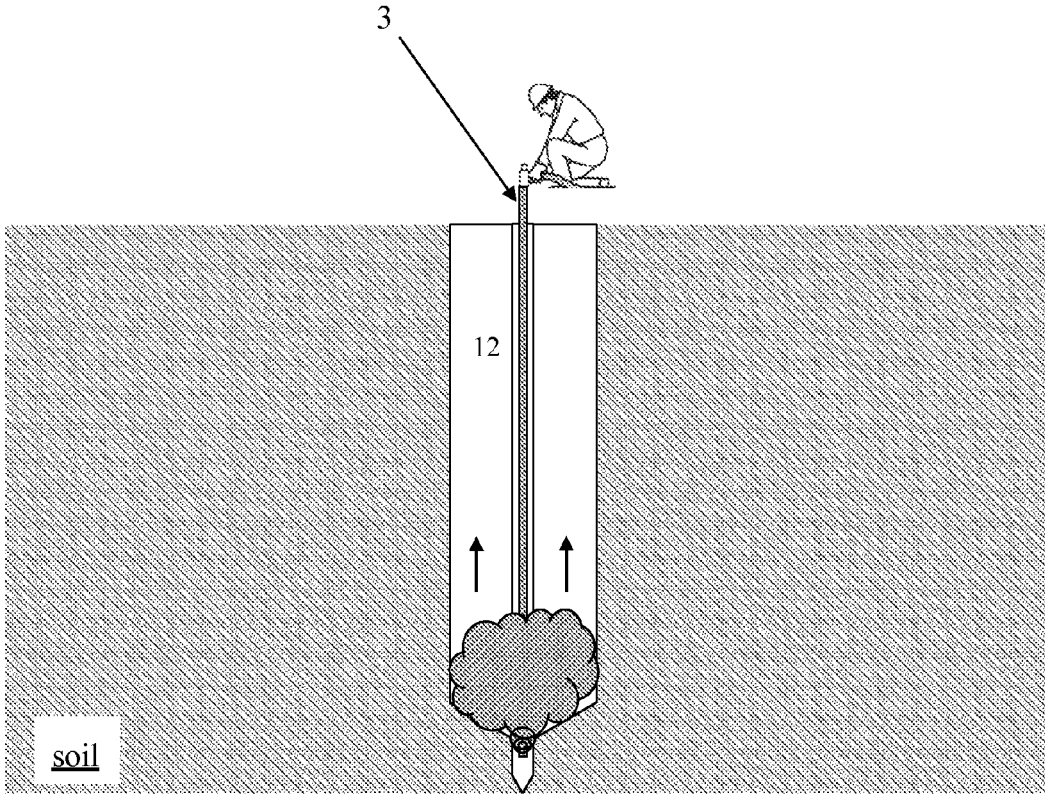
FIG. 2 is a sketch view of grouting the non-water reacted two-component polymer composition into the holes in an elevating manner according to the preferred embodiment of the present invention.
Figure 3:
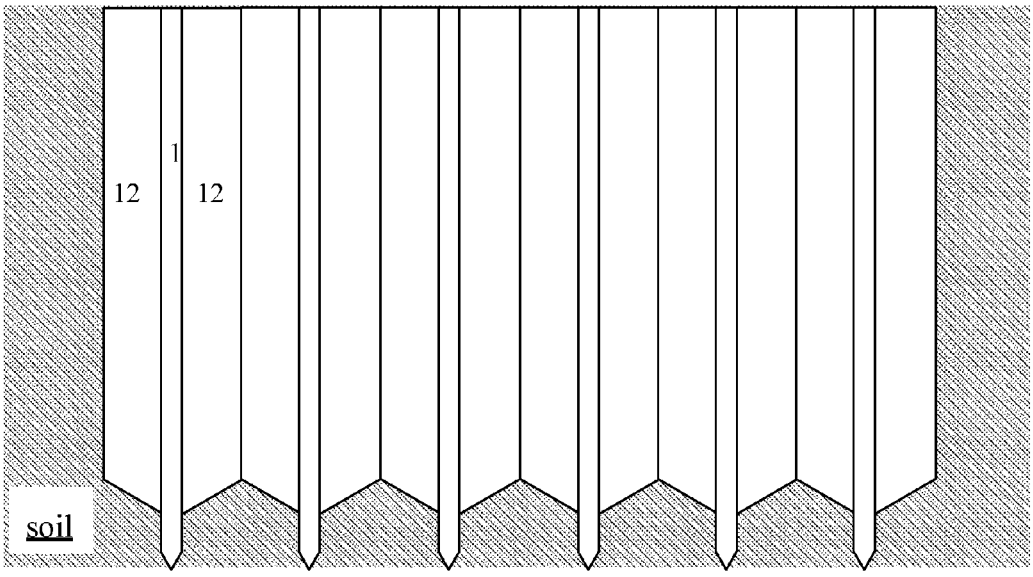
FIG. 3 is a sectional view of a super thin polymer grouting curtain according to the preferred embodiment of the present invention.

Referring to FIG. 1-3, a process for grouting a polymer curtain according to a preferred embodiment of the present invention is illustrated, comprising the steps of:

- forming a series of V-shaped injecting holes 1 along a dam axis placidly at a predetermined spacing distance. Each V-shaped injecting hole 1 comprises a round hole 11 and two wings 12;
- injecting a polymer composition into each of the V-shaped injecting holes 1, wherein the polymer composition expends and coagulates inside the V-shaped injecting holes 1 to form a series of V-shaped curtain segments which then connect with each other, end to end, to form a continuous grouting curtain.

The present invention creatively applies polymer grouting to form an impermeable curtain for dams and dikes to prevent water seeping. The novel process is easy to use, and greatly improves impermeability.

The V-shaped injecting holes 1 are formed by a direct pushing method using a special drilling bit with two wings which guide the polymer composition to form the V-shaped curtain segments in a designed manner. Traditional methods of hole boring generally use rotary drilling. As a result, the holes 1 are round. Additionally, traditional curtain grouting methods generally form a curtain by grouting multiple rows of round holes 1. However, many experiments have shown that the round holes 1 cannot ensure that the curtain segments formed therein connect with each other efficiently. The curtain segments tend to form along with the weakest sections in the soil which are unpredictable and irregular in nature. As a result, the curtain segments cannot be connected in the expected manner.

In the present invention, each V-shaped injecting hole 1 comprises a round hole 11 and two wings 12 extending sideward. The wings 12 are connected with each other end to end to string the holes 1 together. The curtain segments are formed inside the round holes 11 and extend along the wings 12 so that the curtain segments are connected to form a continuous grouting curtain. Therefore, the wings 12 also play a directional role, guiding the curtain segments to connect with each other in a continuous manner so as to form a vertical impermeable layer efficiently.

The two wide wings 12 form a V-shaped structure. Preferably, the open end of the V-shaped structure faces toward the upstream or the direction of the water pressure. When multiple V-shaped holes are overlapped and connected, they form a continuous W-like structure. Hypothetically, if the wings 12 were straight, the straightly lined up curtain segments would be more likely to fail because it is harder for the wings to join with each other precisely in a straight line manner. As such, gaps were far more likely to occur especially when under pressure. The V-shaped wings 12 are better not only because they connect better but also perform better under pressure. When pressed by the water pressure from the upstream, the overlapped wings of the V-shaped segments will be pressed, backing up each other. As such, the curtain segments will be tightened or strengthened even more.

Furthermore, the two wide wings 12 have an included angle $\alpha$ of 160°-170°, which can be adjusted. If the included angle $\alpha$ is too large, the curtain segments will not be able to connect with each other to form the grouting curtain efficiently. On the other hand, if the included angle $\alpha$ is too small, the quantity of the polymer composition used will increase, and the cost will be higher. Therefore, the included angle $\alpha$ of 160°-170° is the most optimal and efficient angle to form the grout curtains.

The V-shaped injecting holes 1 are spaced at a predetermined distance. The spacing is depending by the size of the two wings, and the size of the wings is determined by the power of the direct pushing system and the gel time of the polymer composition. If the width of the wings 12 is too wide, it will be too hard to push the drilling bit into the soil, and the polymer composition may coagulate before filling the wings 12, and, as a result, gaps will be created between the curtain segments. On the other hand, if the width of the wings is too small, more holes will be needed and the cost will be higher. The present invention factors in both the economy and the impermeability considerations, and provides an optimal distance, according to the preferred embodiment, of 60-100 cm.

Injecting the polymer composition comprises the steps of: inserting a plastic pipe into the round hole 11, connecting the pipe with the injection device 3, and injecting the mixed material into the entrance of the pipe with predetermined high pressure. The pipe has an opening at the bottom of the hole 11, where the mixed material flows out from. Under the chemical reaction, the mixed material starts to expand and coagulate after flowing from the opening of the pipe into the bottom of the V-shaped hole 1. Lifting the pipe with designed speed simultaneously, the materials will fill the hole 1 from bottom to top to form a V-shaped super thin polymer curtain segment. Repeating the steps for the holes one by one, the continuous super-thin impermeable curtain is constructed.

The present invention has the following advantages over the conventional impermeable systems:

Improved impermeability—The polymer composition forms a spumescent curtain after reaction. The spumescent curtain is stable and has a service life more than 100 years. Besides, polymer composition excels other materials in the aspect of impermeability. Being flexible, it binds soil firmly and adapts to the change or shift of the surrounding soil well. Therefore, the system and methods that utilizes grout polymer to construct the impermeable curtains as embodied in the present invention surpasses the prior art in impermeability and durability.

Faster construction turnaround time. The system for constructing the polymer grout curtain embodied in the present invention is shorter in construction time. Within 15 minutes, the polymer composition will achieve more than 90% of its full strength capacity. Compared with the prior art, the process embodied in said invention is the fastest. It shortens the conventional construction turnaround time by more than 70%.

Lower cost. The engineering and the execution of the process for grouting a curtain with polymer embodied in the present invention can be optimized in accordance to project-specific requirements, making rooms for cost saving. Compared with the conventional impermeable concrete walls, a polymer grout curtain built by using the system embodied in the present invention will cost much less.

Minimal disturbing impact to dams. The system and method as embodied in the present invention is able to produce polymer grout curtains just a few millimeters thick. It is by far the thinnest, lightest impermeable contain and it has the least disturbing impact to dams during construction as compared to that done by other impermeable systems or methods.

In summary, the present invention provides a novel method and apparatus for constructing super thin polymer grout curtains for dams and dikes. It offers a new technology or means to address the seepage issues associated with dams and dikes. Some advantages of the system embodied in the said invention include faster construction turnaround time, superior impermeability, lower cost, and minimal disturbing impact to dams and dikes.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A process for grouting a curtain, comprising:

forming a series of overlapped V-shaped injecting holes along an axis of a dam or a dam spacedly at a predetermined distance; and injecting a polymer composition into each of the holes, wherein the polymer composition expands and coagulates inside the holes to form a series of V-shaped super thin polymer curtain segments, and the curtain segments connect with each other end to end to form a continuous grouting curtain system, wherein the holes are formed by a direct pushing system using a drilling bit with two wide wings to obtains V-shaped holes, so as to guide the polymer composition to form the curtain segments in a designed manner.

2. The process, as recited in claim 1, wherein each of the holes has a round hole and two wings extending sidewardly from the round hole, and the wings connect with each other end to end to string the holes together, then the V-shaped super thin curtain segments are formed inside the V-shaped injecting holes and the continuous grouting curtain system is constructed.

3. The process, as recited in claim 2, wherein the holes with the two wings form a V-shaped structure which has an opening facing upstream and connects with each other to form a continuous W-shaped structure, so as to strengthen connection between the curtain segments under water pressure of upstream.

4. The process, as recited in claim 3, wherein the two wings have an included angle of 160°-170°, which is adjustable.

5. The process, as recited in claim 4, wherein the distance is designed upon power of the direct pushing system and gel time of the polymer composition to fill the wings before coagulating therein, so as to provide a balance between economy and impermeable effect.

6. The process, as recited in claim 5, wherein the distance is 60-100 cm.

7. The process, as recited in claim 5, wherein grouting the polymer composition comprises: inserting a plastic pipe into the hole; connecting the pipe with an injection device; injecting a mixed material into an entrance of the pipe with predetermined high pressure, wherein under chemical reaction, the mixed material starts to expand and coagulate after flowing from an opening of the pipe into a bottom of the hole; and lifting the pipe with designed speed simultaneously, wherein the mixed material fills the hole from bottom to top, so as to form the V-shaped super thin polymer curtain segment.

8. The process, as recited in claim 7, wherein by repeating the above steps of grouting the polymer composition for the holes one by one, the continuous grouting curtain system, which is impermeable super-thin, is constructed.

9. The process, as recited in claim 4, wherein grouting the polymer composition comprises: inserting a plastic pipe into the hole; connecting the pipe with an injection device; injecting a mixed material into an entrance of the pipe with predetermined high pressure, wherein under chemical reaction, the mixed material starts to expand and coagulate after flowing from an opening of the pipe into a bottom of the hole; and lifting the pipe with designed speed simultaneously, wherein the mixed material fills the hole from bottom to top, so as to form the V-shaped super thin polymer curtain segment.

10. The process, as recited in claim 9, wherein by repeating the above steps of grouting the polymer composition for the holes one by one, the continuous grouting curtain system, which is impermeable super-thin, is constructed.

11. The process, as recited in claim 3, wherein grouting the polymer composition comprises: inserting a plastic pipe into the hole; connecting the pipe with an injection device; injecting a mixed material into an entrance of the pipe with predetermined high pressure, wherein under chemical reaction, the mixed material starts to expand and coagulate after flowing from an opening of the pipe into a bottom of the hole; and lifting the pipe with designed speed simultaneously, wherein the mixed material fills the hole from bottom to top, so as to form the V-shaped super thin polymer curtain segment.

12. The process, as recited in claim 11, wherein by repeating the above steps of grouting the polymer composition for the holes one by one, the continuous grouting curtain system, which is impermeable super-thin, is constructed.

13. The process, as recited in claim 2, wherein the two wings have an included angle of 160°-170°, which is adjustable.

14. The process, as recited in claim 2, wherein the distance is designed upon power of the direct pushing system and gel time of the polymer composition to fill the wings before coagulating therein, so as to provide a balance between economy and impermeable effect.

15. The process, as recited in claim 14, wherein the distance is 60-100 cm.

16. The process, as recited in claim 1, wherein grouting the polymer composition comprises: inserting a plastic pipe into the hole; connecting the pipe with an injection device; injecting a mixed material into an entrance of the pipe with predetermined high pressure, wherein under chemical reaction, the mixed material starts to expand and coagulate after flowing from an opening of the pipe into a bottom of the hole; and lifting the pipe with designed speed simultaneously, wherein the mixed material fills the hole from bottom to top, so as to form the V-shaped super thin polymer curtain segment.

17. The process, as recited in claim 16, wherein by repeating the above steps of grouting the polymer composition for the holes one by one, the continuous grouting curtain system, which is impermeable super-thin, is constructed.

18. A process for grouting a curtain, comprising:

forming a series of overlapped V-shaped injecting holes along an axis of a dam or a dam spacedly at a predetermined distance; and injecting a polymer composition into each of the holes, wherein the polymer composition expands and coagulates inside the holes to form a series of V-shaped super thin polymer curtain segments, and the curtain segments connect with each other end to end to form a continuous grouting curtain system, wherein grouting the polymer composition comprises: inserting a plastic pipe into the hole; connecting the pipe with an injection device; injecting a mixed material into an entrance of the pipe with predetermined high pressure, wherein under chemical reaction, the mixed material starts to expand and coagulate after flowing from an opening of the pipe into a bottom of the hole; and lifting the pipe with designed speed simultaneously, wherein the mixed material fills the hole from bottom to top, so as to form the V-shaped super thin polymer curtain segment, wherein by repeating the above steps of grouting the polymer composition for the holes one by one, the continuous grouting curtain system, which is impermeable super-thin, is constructed.

* * * * *